US008312653B2

(12) United States Patent
Fritsche

(10) Patent No.: US 8,312,653 B2
(45) Date of Patent: Nov. 20, 2012

(54) COLLAPSIBLE TRADESHOW DISPLAY WITH CURVED PANEL

(75) Inventor: Mark A. Fritsche, Eagan, MN (US)

(73) Assignee: Skyline Displays, Inc., Eagan, MN (US)

( * ) Notice: Subject to any disclaimer, the term of this patent is extended or adjusted under 35 U.S.C. 154(b) by 159 days.

(21) Appl. No.: 12/627,878

(22) Filed: Nov. 30, 2009

(65) Prior Publication Data

US 2010/0146834 A1 Jun. 17, 2010

Related U.S. Application Data

(60) Provisional application No. 61/118,763, filed on Dec. 1, 2008.

(51) Int. Cl.
*G09F 15/00* (2006.01)

(52) U.S. Cl. ..... 40/610; 160/135

(58) Field of Classification Search ..... 40/610; 160/135; 211/198, 199
See application file for complete search history.

(56) References Cited

U.S. PATENT DOCUMENTS

| | | | | | |
|---|---|---|---|---|---|
| 1,656,341 | A | * | 1/1928 | Smith | 40/539 |
| 3,231,996 | A | * | 2/1966 | Krauss | 40/571 |
| 4,658,560 | A | * | 4/1987 | Beaulieu | 52/646 |
| 4,865,111 | A | | 9/1989 | Perutz | |
| 4,979,554 | A | | 12/1990 | Nelson | |
| 4,991,813 | A | | 2/1991 | Beaulieu | |
| 5,115,623 | A | * | 5/1992 | Ahlberg | 52/646 |
| 5,439,043 | A | | 8/1995 | Carter | |
| 5,778,580 | A | * | 7/1998 | Zarelius | 40/610 |
| 5,791,391 | A | | 8/1998 | Carter | |
| 5,826,639 | A | * | 10/1998 | Miller | 160/135 |
| 7,191,555 | B2 | * | 3/2007 | Hughes | 40/603 |
| 7,770,313 | B2 | * | 8/2010 | Fritsche | 40/610 |

FOREIGN PATENT DOCUMENTS

| | | | |
|---|---|---|---|
| EP | 1 909 248 | A1 | 4/2008 |
| EP | 1939840 | A1 * | 7/2008 |
| WO | WO 97/03431 | | 1/1997 |

OTHER PUBLICATIONS

Great Britain Examination Report Under Section 18(3), Application No. GB0921080.8, dated Aug. 9, 2012 (5 pgs.).

* cited by examiner

*Primary Examiner* — Lesley D Morris
*Assistant Examiner* — Kristina Junge
(74) *Attorney, Agent, or Firm* — Patterson Thuente Christensen Pedersen, P.A.

(57) ABSTRACT

A collapsible tradeshow display includes curved end panels that provide for easier attachment and eliminate the possibility of dramatic disengagement of the panel from the display. Each end panel has a generally planar body comprised of a resilient material having a tendency to return to a generally flat configuration when in a curved configuration. A pair of side margins extend along opposing vertical sides of the body, each having a bridge portion attached thereto. A connecting means can connect the bridge portions to retain the panel in the curved configuration.

22 Claims, 8 Drawing Sheets

COLLAPSIBLE TRADESHOW DISPLAY WITH CURVED PANEL

PRIORITY

The present application claims the benefit of U.S. Provisional Application No. 61/118,763, filed Dec. 1, 2008, which is incorporated herein in its entirety by reference.

FIELD OF THE INVENTION

The present invention relates to free standing and readily erectable graphic displays such as those used for tradeshows. More particularly, this invention relates to curved panels, particularly curved end panels for such displays and methods of providing such curvature.

BACKGROUND OF THE INVENTION

Displays for tradeshows are generally structures that can be transported, erected on a convention or show floor for a brief period of show time, then disassembled, transported and stored until the next usage. Such displays can be massive complex multi-story structures or simple single banner displays. The massive displays are typically constructed of metal trusses, metal box frames, and large diameter (greater than two ½ inches) metal tubing providing great flexibility in varying designs and offering many accessories such as shelving, lighting, literature racks, and flat panel electronic displays. Such large displays often require crates to store and transport and require trained crews several hours or more to erect. See, for example, U.S. Pat. No. 7,024,834 assigned to Skyline Displays, Inc., the owner of this application, illustrating such displays and U.S. Pat. No. 6,951,283 illustrating a crate and such displays, which are hereby incorporated by reference.

A common simpler tradeshow display comprises a bundled network of interconnected support rods that expands into a volumetrically substantial three-dimensional space. Such expanded structures are then covered with sheet material capable of supporting graphics on the material. Such structures typically have a curved foot print providing an attractive smooth curved surface for the graphics. Such displays may also have vertical supports that may be utilized for supporting shelving and other accessories. The curved footprint effectively provides stability and allows for the attachment of shelves and other appurtenances such as lighting. Such displays can be seen, for example, in U.S. Pat. Nos. 6,829,869 and 4,658,560 assigned to Skyline Displays, Inc., said patents incorporated herein by reference. These displays are often called "pop-up displays."

Many tradeshow displays also include curved end panels. Collapsible tradeshow displays such as illustrated in U.S. Pat. No. 6,829,869, and U.S. Patent Publication 2008/0155873, both incorporated by reference, illustrate the curved end panels on collapsible displays. Such end panels are inherently resilient and seek to return to a flat planar shape when positioned in the curved shape as when they are wrapped around the end of a display framework. Such resiliency causes difficulty in attachment and can result in dramatic disengagement from the framework when inadvertently bumped. Such dramatic disengagement results from the tendency of the panels to snap back to a flat shape upon disengagement from the frame. Means, such as illustrated in 2008/0155873, may be utilized to more securely attach the vertical margins of the end panels to minimize the "dramatic disengagement" but difficulty in attaching the panels still remain. A more robust system would be desirable that allows for easy attachment during the display erection and does not present the potential of the dramatic disengagement.

The graphic displays for the panels of such collapsible displays are conventionally formed of polycarbonate sheets with the graphics media bonded to the polycarbonate sheets. The front panels and side panels are typically formed of slightly different thicknesses of the polycarbonate sheets due to the fact that the end panels need to be more flexible than the front non or minimally curved panels. During the manufacture of the graphics panels there can be differential shrinkage of the sheets with differing thicknesses. This can cause misalignment of graphics between the front panels and curved end panels. Moreover the different thicknesses can have differing light transmission characteristics whereby, particularly for back lit displays, differing levels of illuminations are presented which is undesirable. It would be desirable to be able to utilize the same polycarbonate sheet material for both the curved end panel and the front panels.

SUMMARY OF THE INVENTION

In an embodiment of the invention, a collapsible tradeshow display has a framework assembly that erects into a three dimensional structure onto which front panels are attached by vertical magnetic strips and end panels formed of resilient panelar materials are curved and placed on the left and right ends to provide an essentially continuous smooth uninterrupted graphic display. The front panels and end panels are elongate, panelar sheet material with an inherent resiliency to return to a flat state. The panels are rectangular with two vertical opposing parallel lengthwise margins and an inside surface and an exposed outside surface that may have graphics thereon and typically will have graphics that correlate with graphics exposed on the front covering panels. Bridging comprised of releasable bridge portions extend to connect the opposing margins, securing the end panel in a curved resilient shape. The bridge portions attach to form a bridge by way of a connecting means at a plurality of points along the margin or substantially continuously along a majority of each margin. Bridge portions may comprise a pair of cooperating sheet or fabric strips that are attached at each margin on the interior surface, each strip having an elongate edge adhered or otherwise attached to the margin, or other location of the end panel and an opposite elongate edge with a portion of a zipper or other connecting means. The two zipper portions may be zipped up to provide a continual spanning structure connecting the two margins providing a self sustaining curved shape. Other connecting means such as hook and loop material, eyelets and a rope or string, or discrete hooks or members removably connected between the bridging portions may be used to secure the bridge portions. The end panels so shaped may then easily be attached to the framework by conventional securement means, typically cooperating vertical magnetic strips and a pair of slots at the top corners of the end panel to attach to nubs on the framework assembly.

The invention also includes the discrete curved panels, methods of imparting curvature to curved panels, methods of assembling such trade show displays utilizing the curved panels, modifications of existing tradeshow displays, particularly the end panels to utilize continuous or multiple attachment points to pre-curve the panels before hanging on the framework. In certain embodiments, the discrete curved end panel can be utilized to provide a freestanding display without the pop-up framework structure. Moreover, in certain embodiments, two or more discrete curved end panels can be assembled without the pop up framework into a display that has graphics on all sides.

A feature and advantage of the invention is that the dramatic disengagement when the end panels are bumped on a pop up framework is eliminated. Because the end panels are held in a curved configuration with the connecting means, even if they are disengaged from the display they will not snap back to a flat configuration.

A further feature and advantage of the invention is that assembly of trade show displays is now much easier with the invention without any steps that present a level of difficulty characteristic of the prior art stands. The connection means makes it easy to connect the bridge portions giving the end panels their curved shape and end panels that are pre-curved are much easier to attach to displays. Moreover, the adhesion between the magnetic strips on the curved end panel and the framework is not as critical as prior art displays and may be easily adjusted for alignment without the risk of dramatic disengagement.

A feature and advantage of particular embodiments is that illumination of the interior of pop up displays may be provided by removably attaching lighting strips to the bridging portions securing the curvature. Hook and loop material is suitably utilized to secure lighting strips comprising light emitting diodes or other light sources within the display.

A feature and advantage of embodiments of the invention is that existing pop-up displays may be modified to provide curved end panels as described herein to incorporate the invention and provide the advantages and features. When graphics are replaced the new end panels may readily have the features herein. The balance of the display does not need to be modified to utilize particular aspects of the invention.

Features and advantages of embodiment of the invention include the rectangular body having an opposite side with a bridging portion attached extending between two vertical strip regions extending substantially the height of the rectangular body, the bridging portion having an open position and bridging mode, wherein in the open position the rectangular body may return to a flat planar configuration, wherein when the rectangular body is in the bridging mode the two vertical strip portions are held a specific distance apart to provide a secure curvature to the rectangular body.

DETAILED DESCRIPTION

Figure 1:
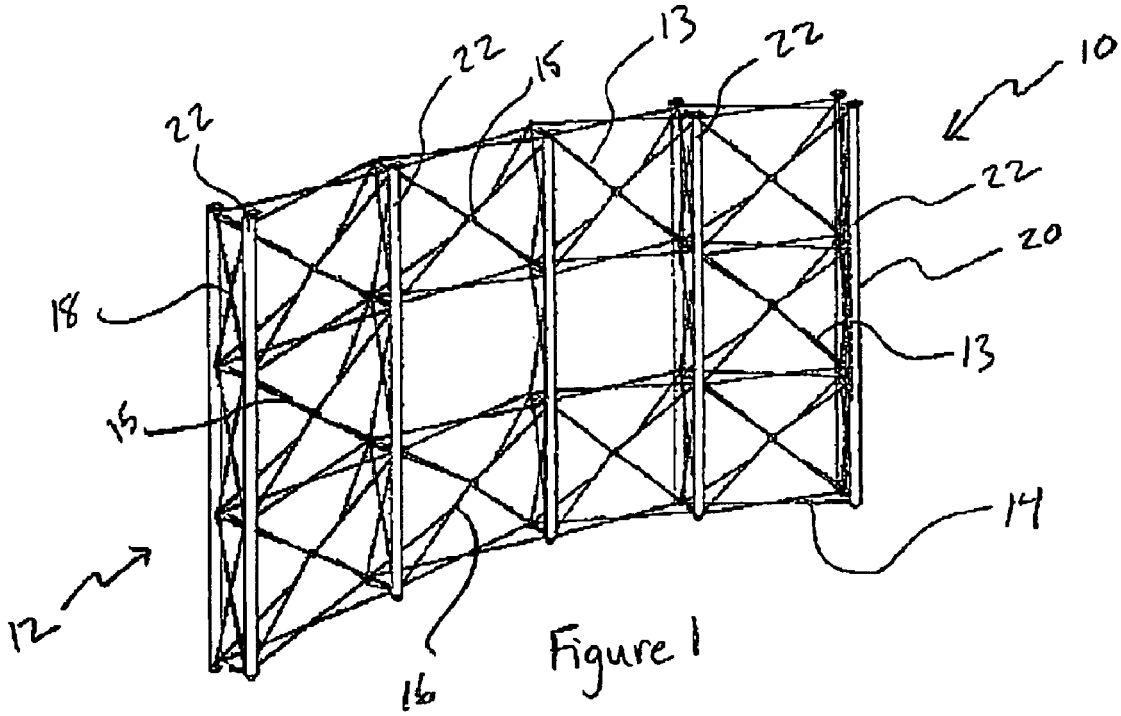
FIG. 1 is a perspective view of a frame assembly for a collapsible tradeshow display.
Figure 2:
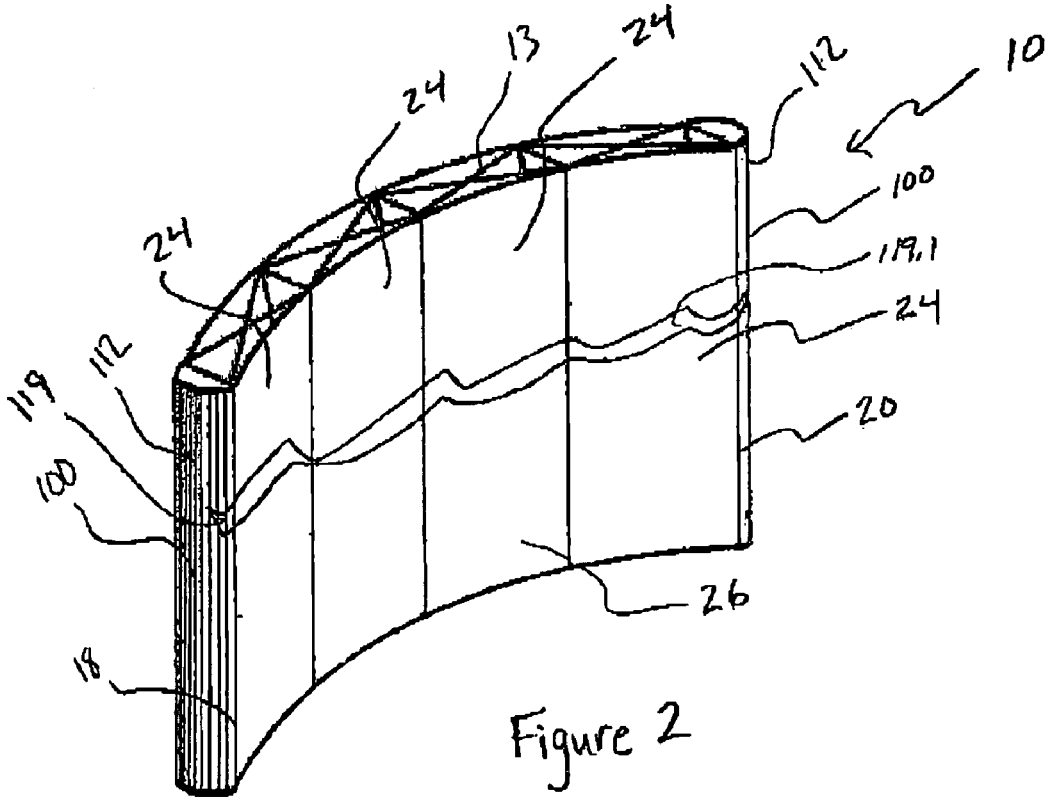
FIG. 2 is a perspective view of a collapsible tradeshow display.

FIGS. 1 and 2 depict a collapsible trade show display 10, known in the industry as a pop-up display. Display 10 includes a frame assembly 12. Frame assembly 12 includes an expandable frame 14, comprised of a plurality of support rods 13 pivotally attached to a plurality of hubs 15 and having a front 16 and opposed left and right ends 18, 20. In one embodiment, frame 14 is comprised of a lightweight yet durable material such as fiberglass. A plurality of vertical channels 22 are connected to front 16 and ends 18, 20 of frame. An example of such a frame is disclosed in U.S. Pat. No. 6,829,869, the content of which is incorporated herein by reference.

Referring to FIG. 2, a plurality of flexible front panels 24 can be attached to display 10 at front 16 of frame 14. In one embodiment, magnetic strips disposed on a rear side of front panels 24 can mate with a magnetic material comprising or attached to channels 22. Outer surfaces 26 of front panels 24 can comprise graphics promoting a company, product, service, etc. Front panels 24 can connect to display 10 such that there is a smooth, seamless transition between panels 24. Display 10 further includes a pair of curved end panels 100 located at each end 18, 20 of display 10.

End panels 100 are more clearly depicted with reference to FIGS. 3A-3B, 7, 8, and 9. End panels 100 can be comprised of an elongate, resilient panelar material having a generally rectangular shape including a body 101 and a top margin 102, bottom margin 104, and a pair of side margins 106. Margins 102, 104, 106 can be integral with body 101 or can be distinct pieces affixed to body with adhesives or the like. In one embodiment, side margins 106 are comprised of a strip 107 of flexible magnetic material affixed to a flexible, non-magnetic body 108. Graphic layer 109 is similarly adhered to the body 108. The body may comprise polycarbonate sheet material 0.015 to 0.030 inches thick. Or suitably in the range of 0.020 to 0.025 inches thick, or suitably about 0.020 inches plus or minus 20%. End panels 100 also include an inner surface 110 and an outer surface 112. Outer surfaces 112 of end panels 100 can include graphics 119 that cooperate with the graphics 119.1 on outer surfaces 26 of front panels 24. End panels 100 can also include notches 108 at outer edges of top margin 102 which can hook on nubs 28 on the framework.

Figure 3A:
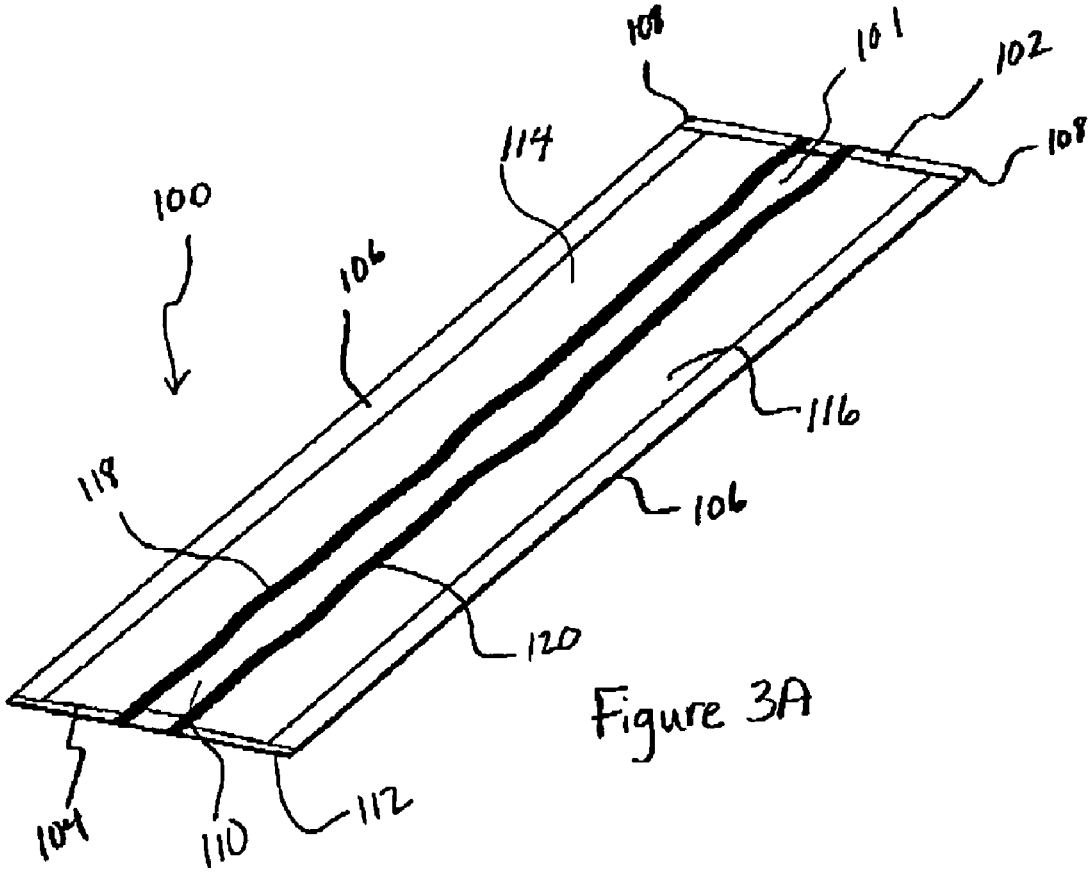
FIG. 3A is a perspective view of an end panel for a collapsible tradeshow display according to an embodiment of the present invention in a flat configuration.
Figure 19:
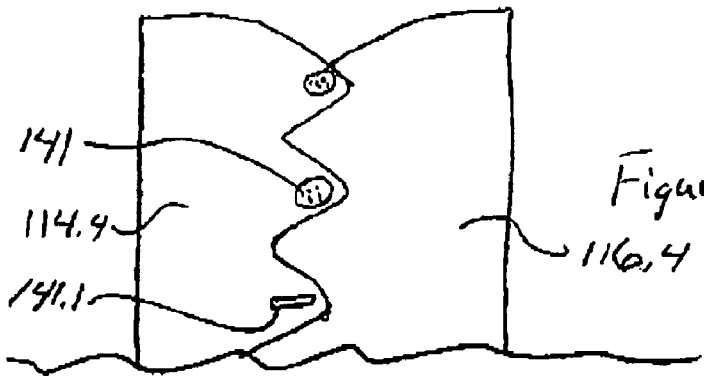
FIG. 19 is a view of an alternate connecting means on the bridging portions.
Figure 16:
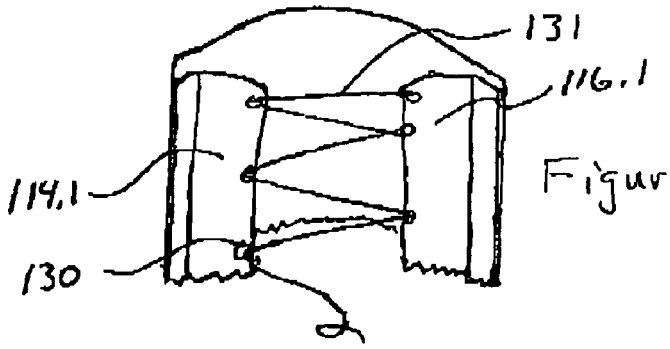
FIG. 16 is a view of an alternate connecting means on the bridging portions.
Figure 17:
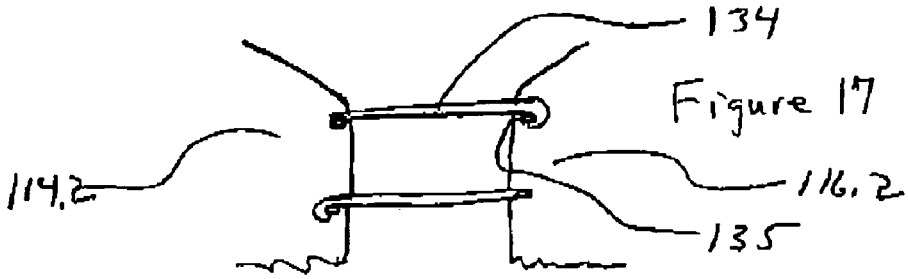
FIG. 17 is a view of an alternate connecting means on the bridging portions.
Figure 18:
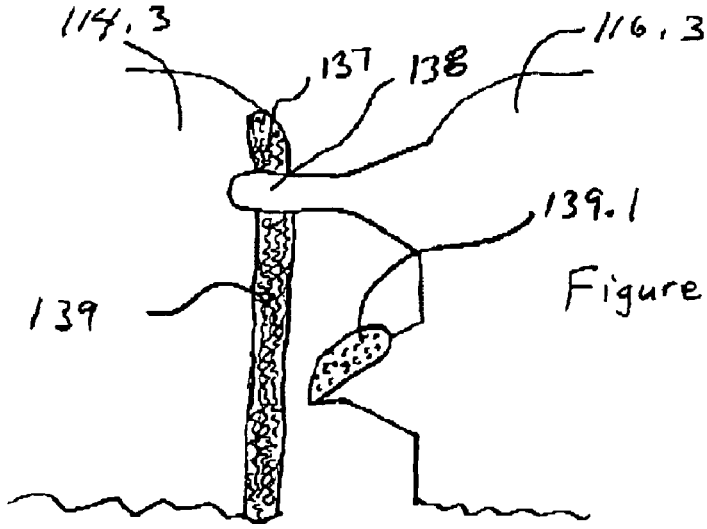
FIG. 18 is a view of an alternate connecting means on the bridging portions.

As can be seen in FIG. 3A, end panels 100 can naturally retain a generally flat configuration. End panels 100 can be brought into a curved configuration with bridge portions 114, 116. Referring to FIGS. 7, 8, 9, and 10, bridge portions 114, 116 forming bridging 115, can comprise a sheet or fabric material and can be affixed to end panels 100 at side margins 106 by any known means, such as, for example, stitching 111 or adhesives. The bridge portions can suitable be stitched directly to the magnetic strip 107 and adhered by adhesives to the body 101. Bridge portions 114, 116 include cooperating connecting means 118, 120. In one embodiment, connecting means 118, 120 comprise a zipper. In other embodiments, connecting means 118, 120 can comprise any other means for removably connecting bridge portions comprised of a fabric or sheet material, such as, for example, buttons or hooks, see FIGS. 16, 17, 18, and 19. FIG. 16 illustrates bridge portions 114.1, 116.1 with eyelets 130 and a drawstring 131. FIG. 17 illustrates bridge portions 114.2, 116.2 with hooks 134 attachable to catches 135. FIG. 18 illustrates bridge portions 114.3, 116.3 with an attachment portion 137 and tabs 138 utilizing hook and loop cooperating material 139, 139.1. FIG. 19 illustrates bridge portions 114.4, 116.4 with buttons 141 and button holes 141.1

Figure 3B:
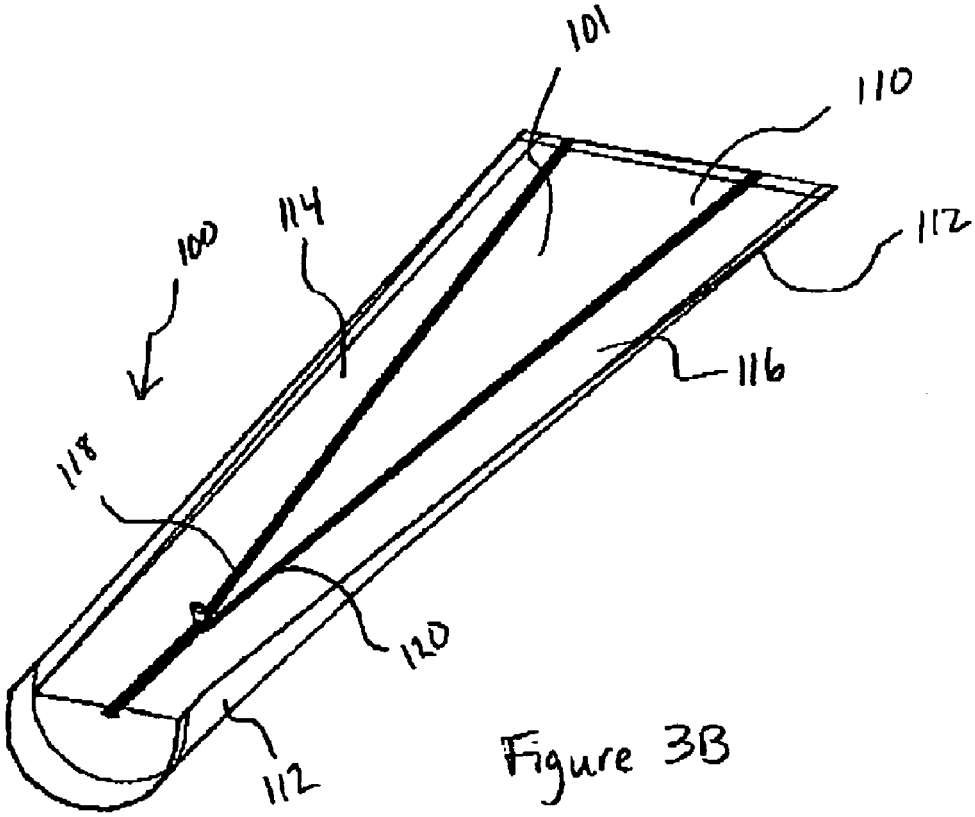
FIG. 3B is a perspective view of the end panel of FIG. 3A in a partially curved configuration.
Figure 3C:
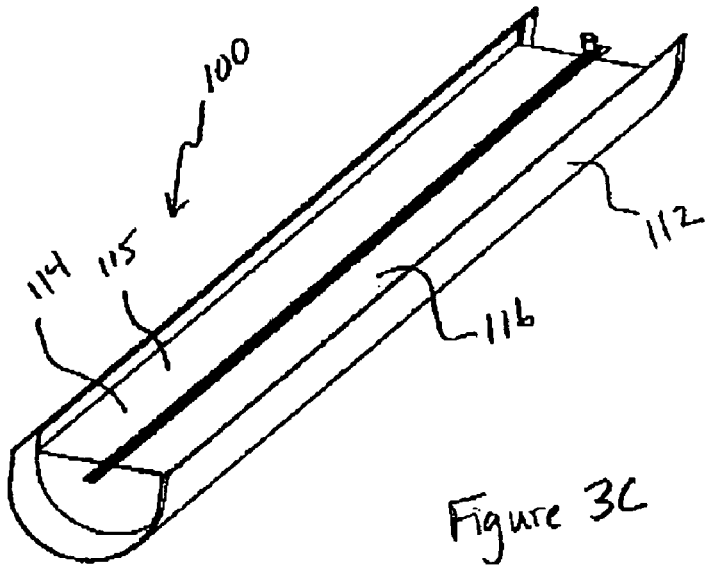
FIG. 3C is a perspective view of the end panel of FIG. 3A is a curved configuration.
Figure 11:
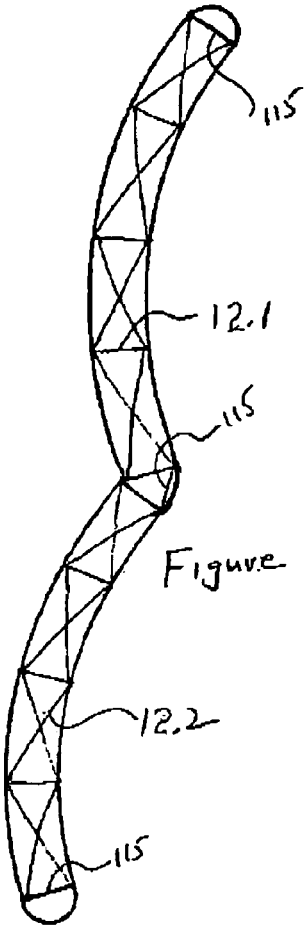
FIG. 11 is a top plan view of two pop-up displays with a central curved panel connecting the front exposed ends of the two frameworks.
Figure 13:
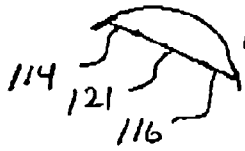
FIG. 13 is a top plan view of central curved panel.
Figure 12:
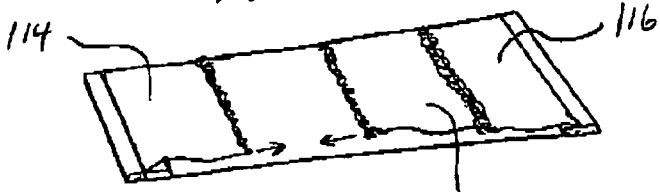
FIG. 12 is a perspective view of the central curved panel of FIG. 11 laid flat.

Referring now to FIG. 3B, end panels 100 can be given a curved configuration by pulling connecting means 118, 120 together and connecting them. Once connecting means 118, 120 are fully connected, as shown in FIG. 3C, end panels 100 retain the desired curved configuration. Bridging with connecting means 118, 120 hold end panels 100 firmly in the curved configuration, which provides for easy installation onto displays and eliminates the "dramatic disengagement" that occurs with previous designs. The amount of curvature can be varied by varying the length of bridge portions 114, 116. The amount of curvature for a single end panel 100 can be varied by including an additional bridge portion 121, see FIGS. 12 and 13. The additional bridge portion can be a strip of fabric or sheet material that can be connected to one of the existing bridge portions, for example bridge portion 114, by an additional connecting means, for example a zipper to form the bridging 115. This effectively lengthens bridge portion 114, so that when it is connected to bridge portion 116, end panel 110 has less curvature. In a situation where two pop-up frameworks 12.1, 12.2 are positioned adjacent one another as illustrated in FIG. 11, the curved panel is a central curved panel attached to two different framework assemblies, providing a gull-wing shaped double pop-up display.

Thus, a single end panel can be given any number of different curvatures, depending on whether an additional bridge portion is used and the length of the additional bridge portion. In some embodiments, temporary hooks or straps may be utilized to provide an initial curvature at one or both ends of the curved end panel prior to making the lengthwise connection.

Figure 4A:
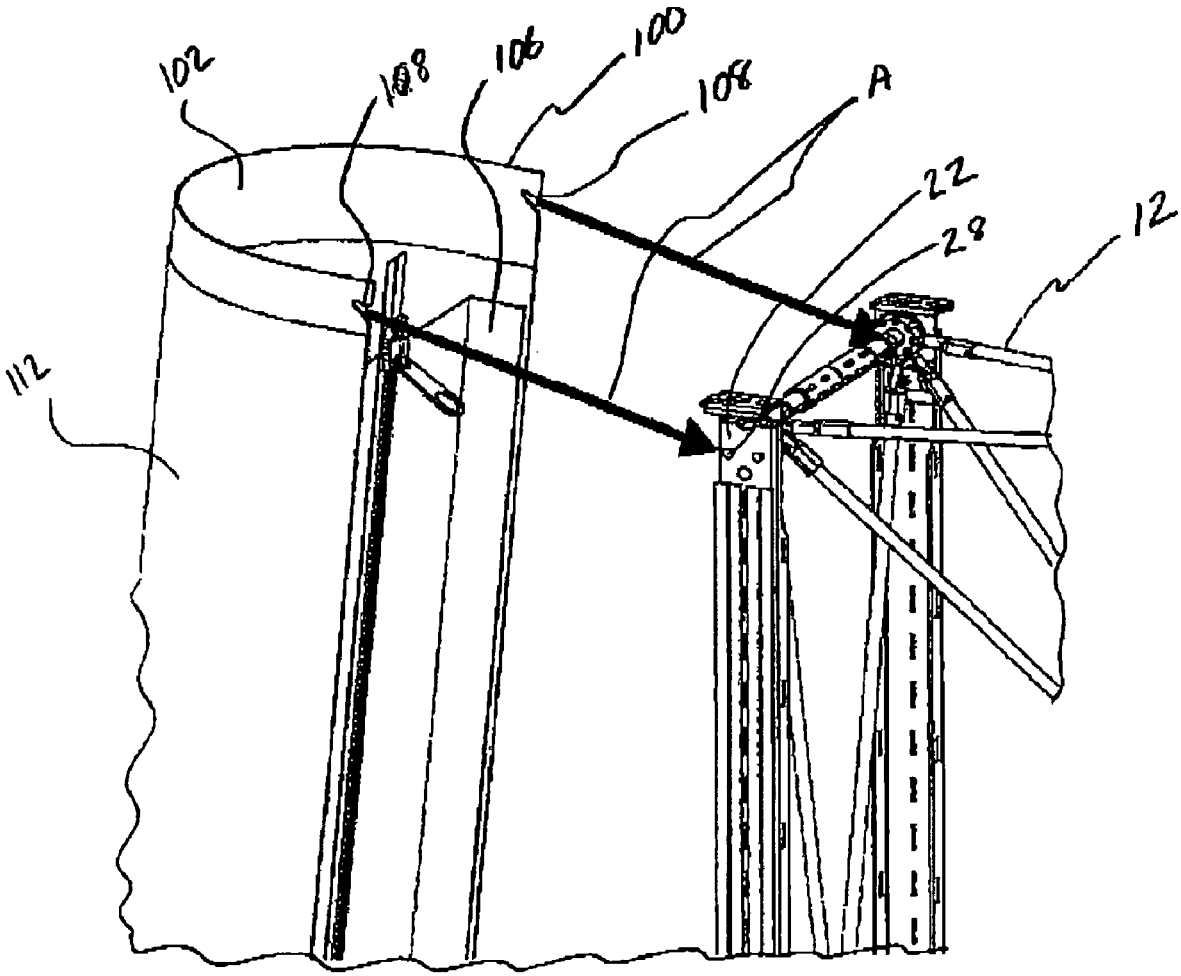
FIG. 4A is a partial perspective view of an end panel and a frame assembly of a collapsible tradeshow display according to an embodiment of the present invention.
Figure 4C:
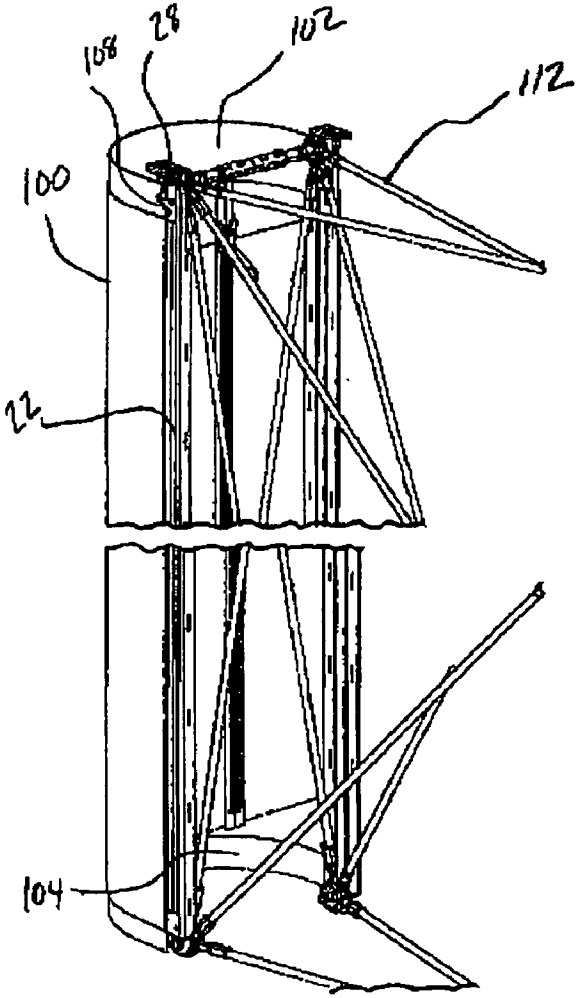
FIG. 4C is a partial perspective view of an end panel installed on a frame assembly of a collapsible tradeshow display according to an embodiment of the present invention.
Figure 4B:
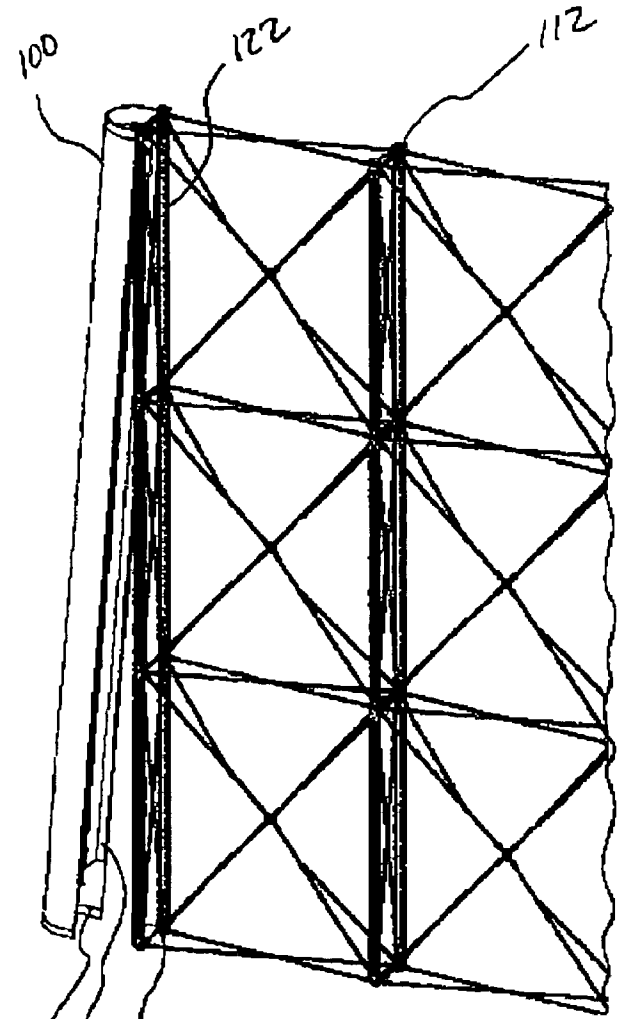
FIG. 4B is a partial perspective view of an end panel partially installed on a frame assembly of a collapsible tradeshow display according to an embodiment of the present invention.

The connection of end panels 100 to frame assembly 12 can be seen with reference to FIGS. 4A-4C. After connecting means 118, 120 have been connected to give the desired curvature to end panel 100, notches 108 in top margin 102 of end panel 100 can be hooked over rivets 28 on channels 22 of frame assembly 12 as indicated by the arrows A in FIG. 4A. In other embodiments, notches 108 can connect to any other portion of frame assembly 112 and notches 22 themselves can comprise any other means for connecting end panel 100 to frame assembly 12, such as, for example, hooks or snaps. Once the upper end of end panel 100 is connected, as shown in FIG. 4B, the bottom end can be swung inwardly and engaged with channels 22 of frame assembly 12. End panel 100 can be held in place on frame assembly 12 by aligning magnets in top 102, bottom 104, and/or side margins 106 with magnetic channels 22. Alternatively, end panel can be held on frame assembly 12 by any other means, such as, for example, additional notches, hooks, or snaps. FIG. 4C depicts a partial view showing the top and bottom of end panel 100 in proper position on frame assembly 112. As noted above, because the curvature of end panels 100 is maintained by connection means 118, 120, attachment of the end panels 100 to the frame assembly 12 is easier and simpler and the chance of a "dramatic disengagement" of end panels of the prior art is eliminated.

Existing tradeshow displays can also be modified to provide the advantages of the present invention. In particular, end panels can be modified to utilize continuous or multiple attachment points to pre-curve the panels before hanging on the framework.

Figure 5:
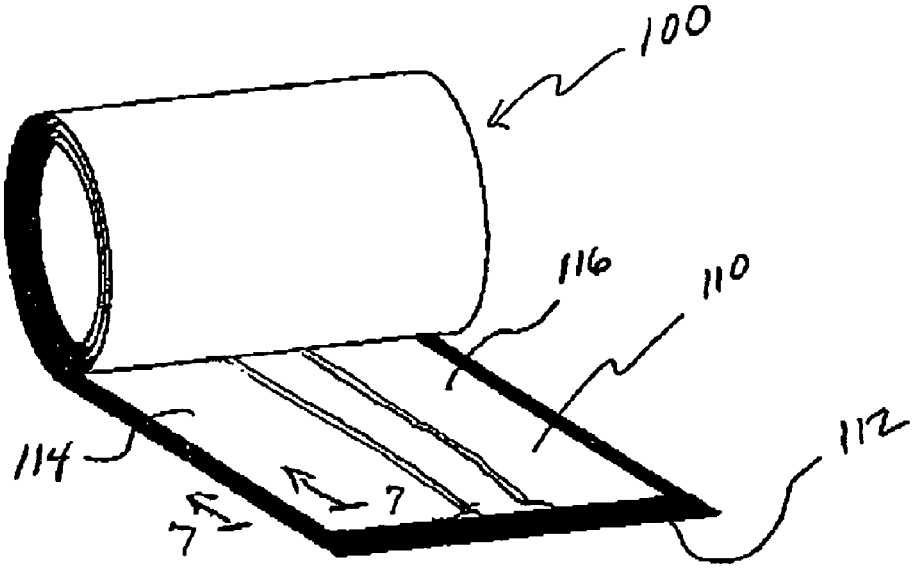
FIG. 5 is a simplified perspective view of an end panel for a collapsible tradeshow display according to an embodiment of the present invention.
Figure 6:
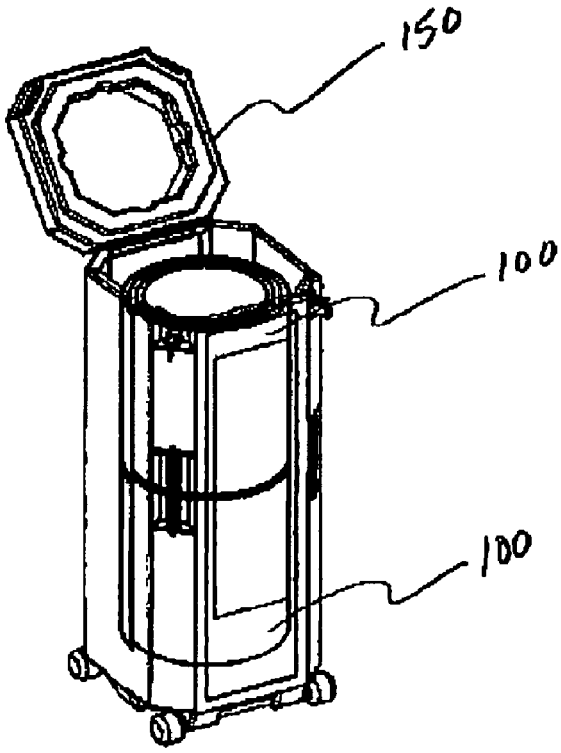
FIG. 6 is a perspective view of a transport case for a collapsible tradeshow display.

When end panel 100 is disconnected from frame assembly 12 and connection means 118, 120 are disengaged, end panels 100 naturally lie flat and can be easily stored for later use. Because end panels 100 comprise a flexible material, they can be rolled into a generally cylindrical shape as shown in FIG. 5. Preferably, end panels 100 are rolled with graphical outer surface 112 facing outwardly and inner surface 110 facing inwardly. End panels 100 can then be stored in a transport case 150 for storage and/or transport as can be seen in FIG. 6.

Figure 7:
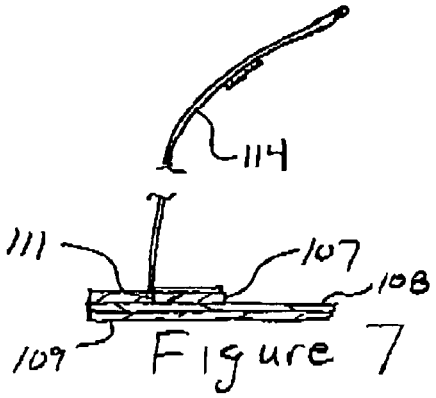
FIG. 7 is a cross sectional view taken at line 7-7 of FIG. 5.
Figure 8:
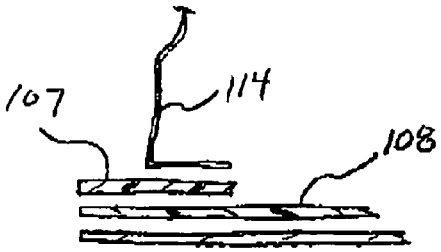
FIG. 8 is an exploded view of the FIG. 7 view.
Figure 9:
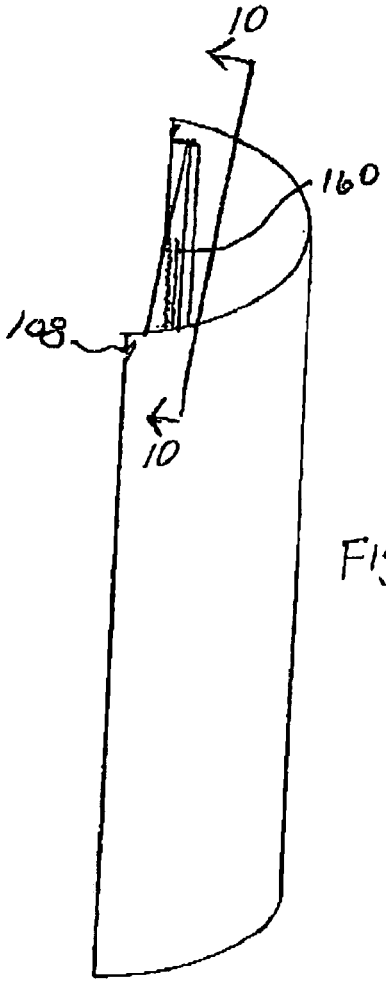
FIG. 9 is a perspective view of a curved end panel according to an embodiment of the present invention with support for back lighting of the display.
Figure 10:
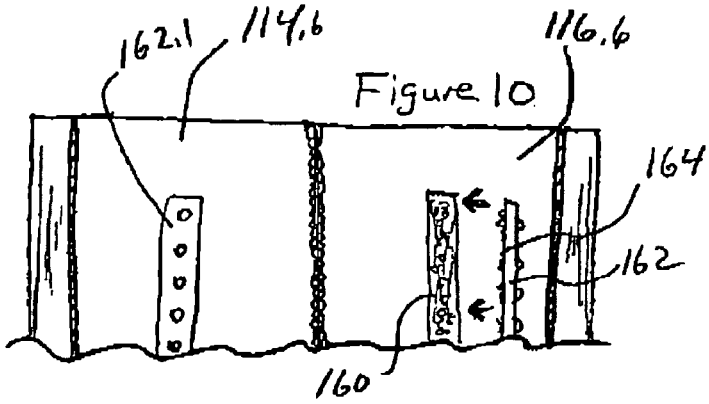
FIG. 10 is a cross sectional view at line 10-10 of FIG. 9.

Referring to FIGS. 7, 9, and 10, the bridging portions 114.6, 116.6 may provide a suitable support for internal back lighting of the pop-up display. The fabric of one or both or three bridging portions may have a strip 160 of one of hook and loop material with a light strip 162 having the other of the hook and loop material 164. A zipper 168 may connect the two bridging portions.

Figure 14:
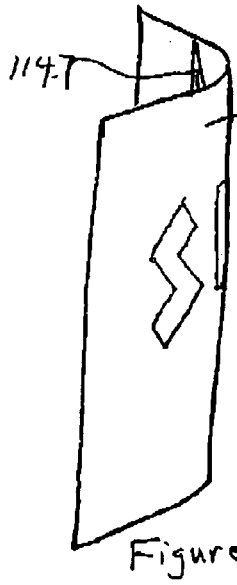
FIG. 14 is a perspective view of a curved panel with bridging portions attached separated from the vertical margins of a panel according to an embodiment of the present invention capable of free standing.
Figure 15:
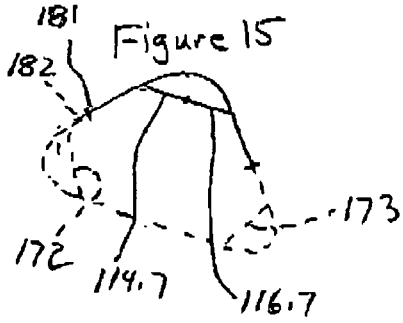
FIG. 15 is a plan elevational view of the curved panel of FIG. 14 with additional curved panels forming an alternative display without a framework structure.

Referring to FIGS. 14 and 15, an embodiment of the invention is illustrated wherein the bridging portions 14.7, 16.7 are attached to the resilient panel 100.1 at a vertical strip region displaced from the margins. Moreover, several such panels, in dashed lines, each with disconnectable bridging 172, 173, may be secured together utilizing magnetic strips or hook and loop material on the respective vertical margins 181, 182 to provide a self supporting display without the necessity of an internal framework.

The embodiments above are intended to be illustrative and not limiting. Additional embodiments are within the claims. Although described with reference to particular embodiments, those skilled in the art will recognize that changes can be made in form and detail. Any incorporation by reference of documents above is limited such that no subject matter is incorporated that is contrary to the explicit disclosure herein.

The invention claimed is:

1. A collapsible tradeshow display comprising:

a frame assembly including a plurality of support rods pivotally attached to a plurality of hubs and including a front and opposed ends;

a plurality of front panels having graphics thereon mounted on the front of the frame assembly;

an end panel having graphics thereon mounted on one of the ends of the frame assembly, the end panel having a curved configuration as mounted and comprising:

a body comprised of a resilient material having a tendency to return to a generally flat configuration from the curved configuration, the body having an outer surface, an inner surface, a top edge, a bottom edge, and an opposing pair of vertical edges;

a pair of bridge portions, one attached at each side margin inwardly of each of the vertical edges; and a connecting means for connecting the bridge portions, wherein when the connecting means is connecting the bridge portions the end panel may be secured in the curved configuration without rigid vertical supports and when the bridge portions are not connected to one another the end panel returns to the generally flat configuration;

wherein the bridge portions are flexible whereby when the bridge portions are not connected to one another, the end panel to be rolled up into a generally cylindrical shape in a direction between the top edge and bottom edge.

2. The display of claim 1, wherein the bridge portions are comprised of a sheet or fabric material.

3. The display of claim 1, wherein the connecting means provides a substantially continuous attachment along adjacent vertical edges of the bridge portions extending at least substantially all of a vertical length of the body of the end panel.

4. The display of claim 1, wherein the connecting means provides a plurality of discrete points of attachment between the bridge portions.

5. The display of claim 1, wherein a pair of side margins comprise an elongate flexible magnetic material that is not unitarily formed with the body and is configured to connect with a magnetic material on frame assembly.

6. The display of claim 1, wherein the connecting means comprises a zipper.

7. The display of claim 1, wherein the end panel is a first end panel and the display further comprising a second end panel having graphics thereon mounted on the other of the opposed ends of the frame assembly and having a structural configuration same as the first end panel.

8. The display of claim 1, wherein the graphics on the end panels are configured to match the graphics on the front panels.

9. An end panel for use with a collapsible tradeshow display, comprising:

a planar body comprised of a resilient material having a tendency to return to a generally flat configuration from a curved configuration, the body having an outer surface and an inner surface and a top edge, a bottom edge, and an opposing pair of vertical edges;

a pair of generally flexible side margins adjacent each of the opposing vertical edges of the body on the inner surface of the body; and a pair of flexible bridge portions attached at each side margin inward of the vertical sides on the inside surface, each bridge portion having a vertically elongate configuration and connectable with each other to put the end panel in the curved configuration, wherein the pair of flexible bridge portions are flexible whereby when the panel is in the generally flat configuration it may be rolled up in a direction between the top edge and bottom edge.

10. The display of claim 9, wherein the bridge portions are comprised of a sheet or fabric material.

11. The display of claim 9, wherein when the bridge portions are connected they provide a substantially continuous attachment along adjacent vertical edges of the bridge portions extending at least substantially all of a vertical length of the body of the end panel.

12. The display of claim 9, wherein when the bridge portions are connected they provide a plurality of discrete points of attachment between the bridge portions.

13. The display of claim 9, wherein the side margins comprise an elongate flexible magnetic material that is not unitarily formed with the body and is configured to connect with a magnetic material on a frame assembly.

14. A method of assembling a collapsible tradeshow display, comprising:

expanding a frame assembly including a plurality of support rods pivotally attached to a plurality of hubs from a collapsed position to an expanded position, the expanded position defining a front and a pair of opposed ends;

mounting a plurality of front panels having graphics thereon to the front of the frame assembly;

causing a pair of end panels each having a body defined by a top edge, a bottom edge, and an opposing pair of vertical edges that define an outer surface and an inner surface to go from a generally flat configuration to a curved configuration by connecting to each other a pair of vertically elongate flexible bridge portions, the bridge portions attached adjacent to the opposing vertical side edges on the inner surface of the end panels; and mounting each end panel whilst in the curved position to one of the opposed ends of the frame assembly.

15. The method of claim 14, wherein the step of connecting the pair of bridge portions includes connecting a connecting means disposed on the bridge portions.

16. The method of claim 15, wherein the step of connecting the connecting means includes connecting the bridge portions substantially continuously along adjacent vertical edges of the bridge portions along at least substantially all of a vertical length of the body of the end panel.

17. The method of claim 15, wherein the step of connecting the connecting means includes connecting the bridge portions at a plurality of discrete points along the bridge portions.

18. The method of claim 14, wherein the step of mounting each end panel includes flexible mating magnets on and not unitary formed with opposing vertical side margins of each end panel with magnets on the frame assembly.

19. The method of claim 14, wherein the step of causing the pair of end panels to go from a generally flat configuration to a curved configuration occurs before the step of mounting each end panel to one of the opposed ends of the frame assembly.

20. A collapsible tradeshow display comprising:

a plurality of panels having graphics thereon, the panels each comprising a generally rectangular body comprised of a resilient polymer sheet material having a resilient tendency to return to a flat planar configuration when put into a curved configuration;

graphics disposed on one side of the generally rectangular body;

the rectangular body having an opposite side with a vertically elongate and flexible bridging attached and extending between two generally flexible vertical strip regions extending substantially the height of the rectangular body, the bridging connected to the vertical strip regions inward of opposing vertical edges of the body and having an open position and bridging mode, wherein in the open position the rectangular body may return to a flat planar configuration, wherein when the rectangular body is in the bridging mode the two vertical strip portions are held a specific distance apart to provide a curvature to the rectangular body, and wherein when the in the open position, the rectangular body may be rolled up in the direction of the elongate direction of the bridging.

21. A method of providing a curvature to a resiliently flexible display panel with graphics thereon, the display panel having an outer surface and an inner surface defined by a top edge, a bottom edge, and an opposing pair of vertical edges, the method comprising removably connecting vertically elongate and flexible bridging fixed to the panel on the back side inner surface of the panel to secure the panel in a curved state, whereby when the bridging is disconnected, the display panel with the disconnected bridging may be rolled up in a direction between the top edge and bottom edge.

22. A method of providing a curvature to a resiliently flexible display panel with graphics thereon, the display panel having an outer surface and an inner surface defined by a top edge, a bottom edge, and an opposing pair of vertical edges, the method comprising connecting vertically elongate releasable bridging to secure the panel in a curved state, the releasable bridging attached to flexible side margins inward of the vertical edges, each side margin disposed on only the inner surface of the panel adjacent one of the vertical edges.

* * * * *